United States Patent [19]

Yano et al.

[11] 4,392,421

[45] Jul. 12, 1983

[54] RICE HULLING AND SORTING DEVICE

[75] Inventors: Noriyuki Yano, Kochi; Satoru Yahashi, Nangoku; Kanzo Shimazaki, Nangoku; Mitsuaki Nakazawa, Nangoku; Takashi Yamamoto, Nangoku, all of Japan

[73] Assignees: Seirei Industry Company Limited, Okayama; Yanma Agricultural Equipment Company Limited, Osaki, both of Japan

[21] Appl. No.: 248,453

[22] Filed: Mar. 27, 1981

[30] Foreign Application Priority Data

| | | | |
|---|---|---|---|
| Mar. 27, 1980 | [JP] | Japan | 55-121472 |
| Mar. 27, 1980 | [JP] | Japan | 55-39975 |
| Mar. 27, 1980 | [JP] | Japan | 55-39976 |
| Mar. 27, 1980 | [JP] | Japan | 55-41023 |
| Mar. 27, 1980 | [JP] | Japan | 55-41025 |
| Mar. 27, 1980 | [JP] | Japan | 55-41026 |
| Mar. 27, 1980 | [JP] | Japan | 55-41032 |

[51] Int. Cl.[3] ..... B02B 3/04; B02B 7/02

[52] U.S. Cl. ..... 99/524; 99/525; 99/529; 99/610; 99/621; 209/687

[58] Field of Search ..... 99/518, 519, 523, 524, 99/600, 601, 609–611, 617, 618, 620–622; 209/136, 137, 684, 687; 241/6, 7, 80, 9–11

[56] References Cited

U.S. PATENT DOCUMENTS

| | | | |
|---|---|---|---|
| 2,182,638 | 12/1939 | Mjolsness | 209/687 |
| 2,672,235 | 3/1954 | Freeman | 209/687 |
| 3,952,645 | 4/1976 | Satake | 99/621 |

*Primary Examiner*—Philip R. Coe
*Assistant Examiner*—Timothy F. Simone
*Attorney, Agent, or Firm*—Fisher, Christen & Sabol

[57] ABSTRACT

A rice hulling and sorting machine includes a pair of hulling rolls which drop husked rice grains into a pneumatic sorting compartment which the husks are preliminary sorted from the rice grains; the rice grains thereafter being thrown upwardly into one end of the upper of two horizontally mounted rotating sorting cylinders. The interior surfaces of these cylinders have a multitude of recesses for trapping single rice grains at the bottom of their circumferential paths of movement to carry them upwardly and dropping them into conveying troughs which run the length of the interiors of the cylinders. Rice grains which are not trapped in the upper cylinder are fed back into the hulling rolls while those dropped into the upper trough are fed to the lower interior of the lower cylinder where they are again subject to being trapped in the recesses of the lower cylinder and dropped into the lower conveyor trough. Rice grains which are not trapped in the lower trough are fed back into the pneumatic sorting compartment while those dropped into the lower trough are discharged from the machine. An angularly adjustable plate extends along one side of each trough which controls the location in the circumferential path at which trapped rice grains fall into each trough.

8 Claims, 7 Drawing Figures

RICE HULLING AND SORTING DEVICE

BACKGROUND OF THE INVENTION

This invention relates to a rice hulling and sorting device comprising in combination a rotary type grain sorter which sorts and separates rice grains into husks and unpolished ones with a huller.

BRIEF SUMMARY OF THE INVENTION

An object of this invention is to provide a vibrationless rotary type grain sorter easy to operate requiring none of the skill of sorting rice depending on the shape and size of rice grains differing according to the kind or the degree of dryness thereof.

Another object of this invention is to provide a rice hulling and sorting device of compact size in which a plurality of revolving sorting cylinders comprising a rotary type grain sorter are provided for the purpose of improving capability and accuracy of grain separation and sorting and of making smoother and easier the operation of conveyance or return of grains to hulling, pneumatic sorting and other sorting parts with an improved combination of the rotary type grain sorter with the huller.

Still another object of the invention is to provide an adjusting device easy to operate for improving accuracy in sorting and separating husks and unpolished rice grains according to the revolving sorting cylinders.

Yet another object of the invention is to provide a rice hulling and sorting device in which power transmission parts for the hulling part, pneumatic sorting elements, and the rotary type grain sorter are collectively arranged so as to be high in safety and to perform efficient power transmission without obstructing the conveyance and return of husks and unpolished rice grains to every part.

A description of an embodiment of this invention will be made referring to the drawings.

BRIEF DESCRIPTION OF THE DRAWINGS

The annexed drawings show an embodiment of this invention wherein:

FIG. 1 is a side elevation of the entire body of a rice hulling and sorting device in which the huller F comprises a hulling part D mounted above an end portion of the pneumatic sorting part E in the shape of a long cabinet including the 2nd conveyor 7, mixed rice conveyor 8, and unpolished rice conveyor 9 which all extend within troughs so that an air current for sorting may flow upwardly toward and above every conveyor and the small rice reservoir 14 by adapting the suction port 11 of the suction dust discharger 10 lying at one longitudinal end of the pneumatic sorting part E to communicate with an opening 12 above the mixed rice conveyor 8 and suction monitor 13 on the longitudinal end of the pneumatic sorting part E.

Figure 1:
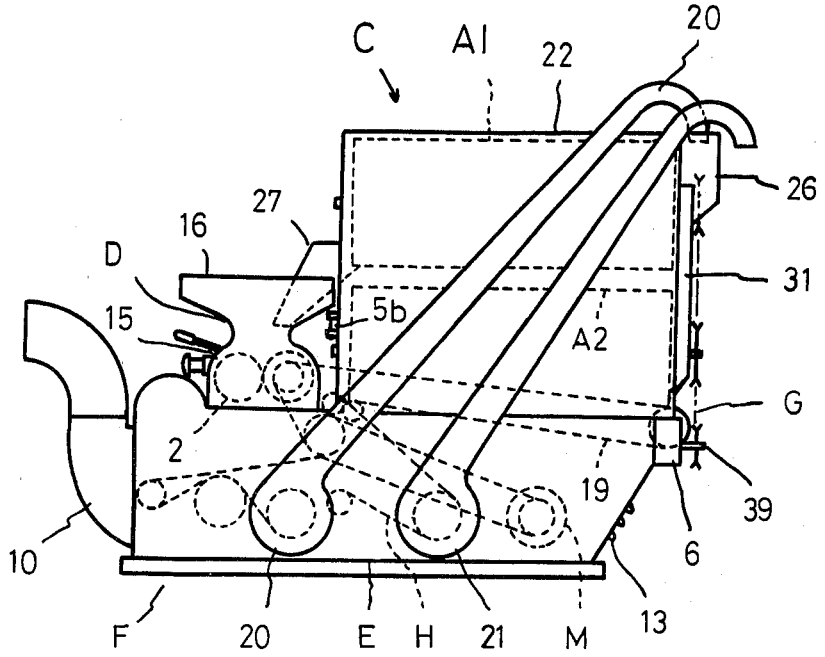
FIG. 1 is a side elevation of a rice hulling and sorting device.
Figure 2:
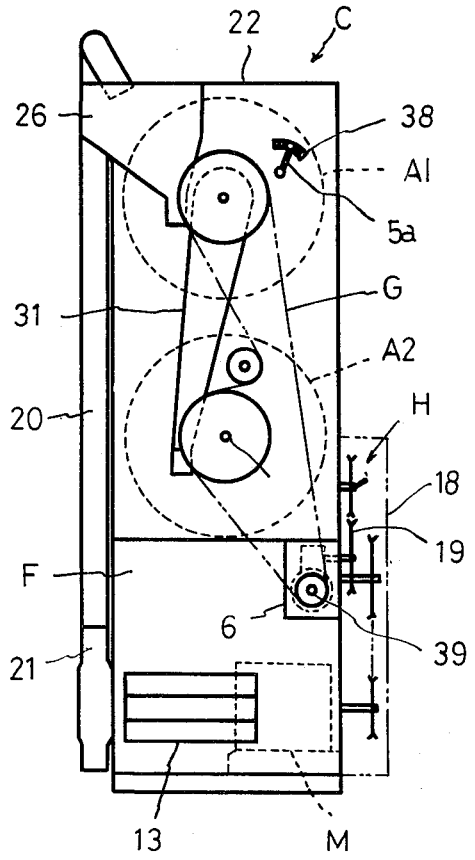
FIG. 2 is a rear view of said device corresponding to the right end face thereof in FIG. 1.
Figure 3:
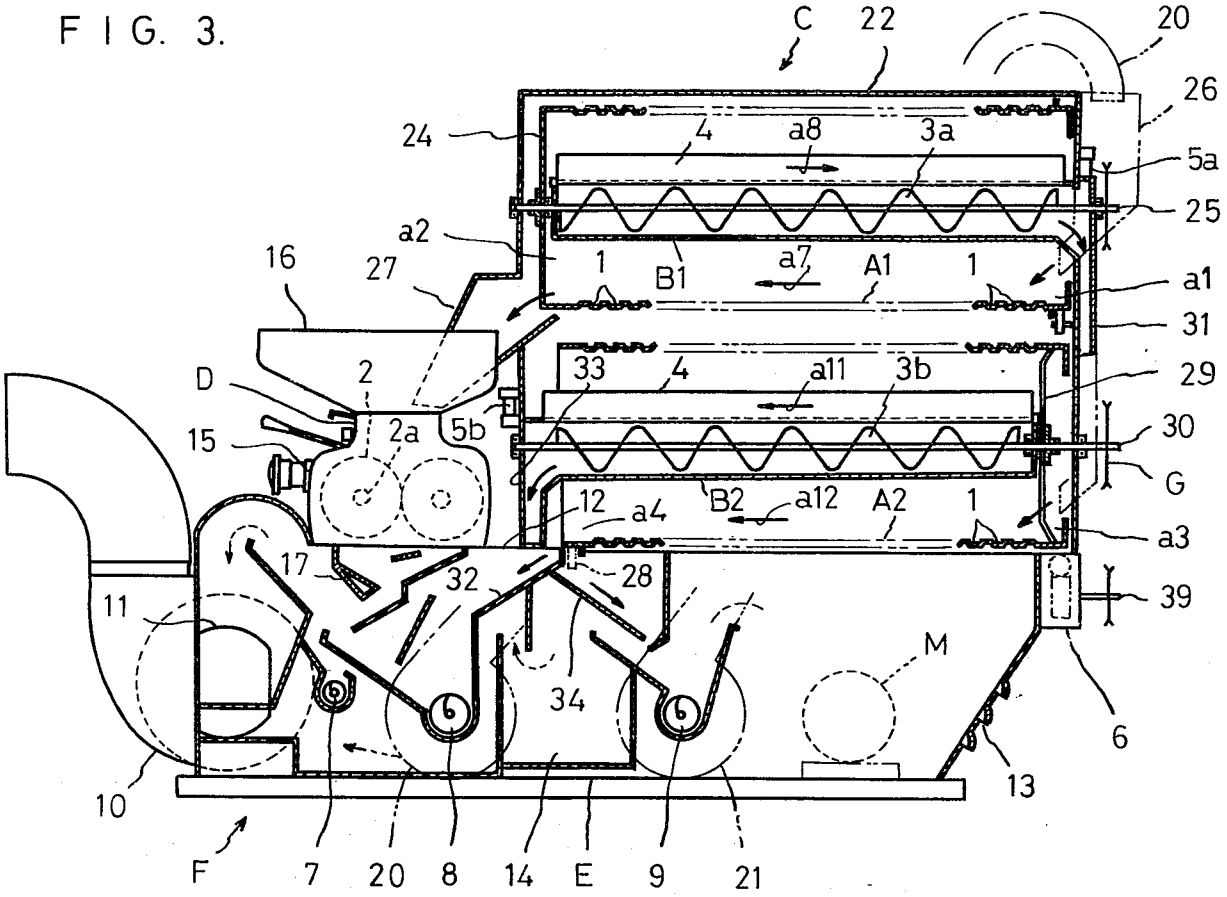
FIG. 3 is a sectional view thereon in FIG. 1.
Figure 4:
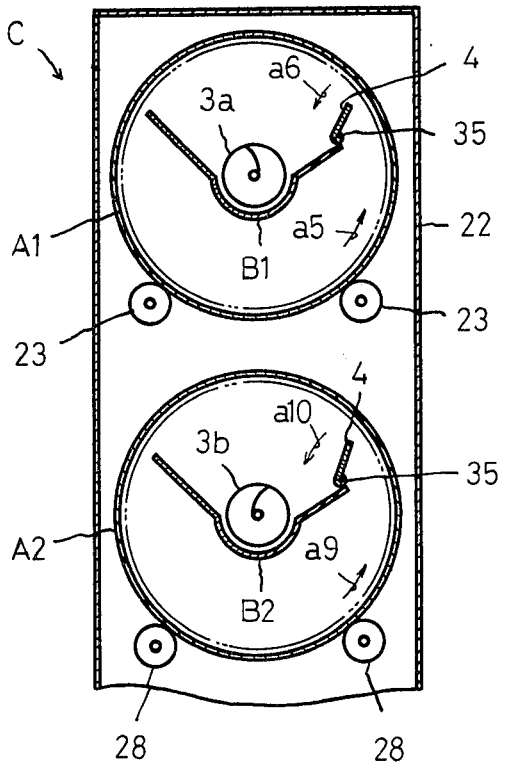
FIG. 4 is a partial sectional view of a rotary type grain sorter.
Figure 6:
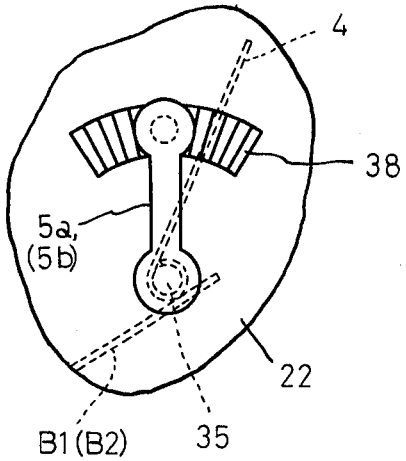
FIG. 6 is a partial front view of an adjusting means.
Figure 7:
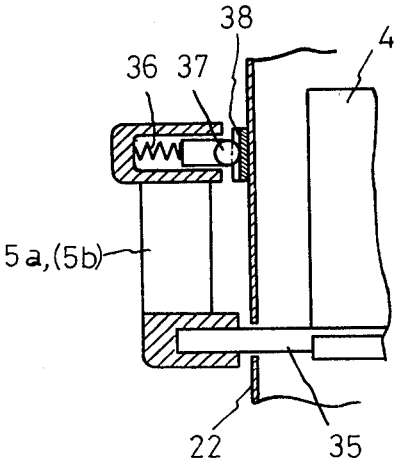
FIG. 7 is a partial side view therein in FIG. 6.
Figure 5:
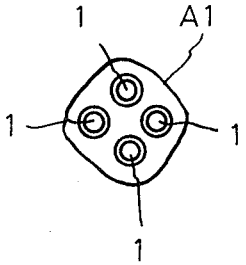
FIG. 5 is a partial view of the interior surface of a revolving sorting cylinder.

Said hulling part D is composed of a hopper 16 disposed above the hulling part 15 having two rolls 2 internally arranged and the grain flowing board 17 lying above said mixed rice conveyor 8. A power transmission part H consisting of a group of belt-pulley means and covered with a safety cover 18 is provided on the side of the cabinet of said pneumatic sorting part E for driving the conveyor 7, 8, and 9 and hulling rolls 2. The power transmission part H is adapted to be driven by the motor M arranged in the cabinet of the pneumatic sorting part E and power is transmitted from the power transmission part H, to a gear case 6 disposed above and at the other longitudinal end of the pneumatic sorting part E through the belt-pulley means; and a mixed rice thrower 20 and an unpolished rice thrower 12 communicating with the mixed rice conveyor 8 and unpolished conveyor 9, respectively, are provided on the other side of the case of the pneumatic sorting part E opposite to the side of the transmission part H.

A rotary type grain sorter C whose width is roughly equal to that of the cabinet-shaped pneumatic sorting part E is mounted above said sorting part E so as to extend longitudinally from a point near said hulling part D to the other end of said pneumatic sorting part: two revolving sorting cylinders A1 and A2 having a large number of recesses 1 . . . , each being sized so as to receive a grain of unpolished rice, formed on the internal surface thereof. These cylinders being opened at both ends are disposed so that the axial directions thereof are perpendicular to the shaft 2*a* of the hulling roll of the hulling part D.

The bottom part of periphery of one end of the upper revolving sorting cylinder A1, which is opposite to said hulling part D, is rotatably mounted on the rollers 23 and 23 arranged in the cabinet 22; the major part of the support arm 24 connected to the other end A2 of said sorting cylinder A1 is mounted on one end of the revolving shaft 25 bearingly supported by the cabinet 22. An unpolished rice receiving trough B1 in the shape of a V in cross section, whose end is connected to the cabinet 22 on one end a1 of the upper revolving sorting cylinder A1, is extended within said sorting cylinder A1 along almost the entire length thereof. A spiral conveyor 3*a* is supported in the lower longitudinal center of said receiving trough B1 so as to be driven coaxially with said revolving shaft 25. The lower opening of the feed tank 26, which is attached to the upper one end of the cabinet 22 and into which the upper end of said mixed rice thrower 20 is slightly thrust, is extended so as to be slightly thrust into the inside of one end portion a1 of the upper revolving sorting cylinder A1 and a husk trough 27 slightly thrust into the lower part of an opening on the other end porting a2 of the upper revolving sorting cylinder A1 is extended so as to communicate with the hopper 16 of said hulling part D.

The bottom part of the periphery of one end a4 of said lower revolving sorting cylinder A2, which is on the side of said hulling part D, is rotatably mounted on the rollers 28 and 28; and the major part of the support arm 29 connected to the other end A3 of said sorting cylinder A2 is mounted on one end of the revolving shaft 30 bearingly supported by the cabinet 22 and an unpolished rice receiving trough B2 in the shape of V is cross section, whose one end is connected to the cabinet 22 on one end A4 of the lower revolving sorting cylinder A2, is extended within said sorting cylinder A2 along almost the entire length thereof. A spiral conveyor 3B is supported in the lower longitudinal center of said receiving trough B2 so as to be driven coaxially with said revolving shaft 30, and the bottom opening of the feeding trough 31 secured to one end of said cabinet 22 and having its top communicating with the end of said receiving trough B1 is extended so as to be slightly thrust into the interior of the other end a3 of the lower revolving sorting cylinder A2. One end a4 of the lower revolving sorting cylinder A2 is adapted to communicate with said mixed rice conveyor 8 through a flow-down plate 32, and the lower part of the trough 33 provided under the end of the receiving trough B2 near one end a4 of the revolving cylinder A2 is adapted to communicate with the upper part of the flow-down plate 34 disposed above said unpolished rice conveyor 9.

Therefore, one end of the rotary type grain sorter C corresponds to the feeding end and the other end of the sorter C corresponds to a discharge end.

Slantwise extending adjusting plates 4 and 4 are provided one-slidely in the relatively high positions in said receiving trough B1 and B2 along almost the entire lengths of spiral conveyors 3*a* and 3*b* so as to be close to the internal surface of the respective sorting cylinders A1 and A2 and, further, to turn about lower axes 35 and 35 for changing of the slant degree. Handles of adjusting means 5*a* and 5*b* are rigidly fitted at one end of both axes 35 and 35 outwardly protruding from the cabinet 22. Pins 37 and 37 are fitted into tips of the adjusting means 5*a* and 5*b* through the interlaid springs 36 and 36 so as to be brought into engagement with arc-shaped fluted segments 38 and 38. The upper adjusting means 5*a* is disposed on the cabinet 22 on the side opposite to the hulling part D, i.e., on the side of the feed tank 26, whereas the lower one 5*b* is disposed on the cabinet 22 on side of the hulling part D.

Ends of said two revolving shafts 25 and 30 are extended above and below, respectively, to the outside of the cabinet 22 on the rear end of the rotary type grain sorter C, which is opposite to said hulling part D, so that these shafts 25 and 30 may be driven by power transmitted from the transmission shaft 39 protruding rearwardly from the gear case 6 through the power transmission part G consisting of belt-pulley means, which is covered with a safety cover (not illustrated).

Therefore, power can be transmitted from the power transmission part H disposed on the side of the pneumatic sorting part E to every part of the huller F, and the rotary type grain sorter C can also be driven by power from the transmission part G through the gear case 6 to which power is transmitted from the power transmission part H.

Among husky rice grain fed into the hopper 16, those which have been hulled in the hulling part D are pneumatically sorted in the pneumatic sorting part E, conveyor 8, are thrown upward to the feed tank 26 by the mixed rice thrower 20. Out of the mixed rice grain fed through the lower opening of said tank 26 to the interior in one end a1 of the upper revolving sorting cylinder A1 and pressed to the internal surface of said sorting cyclinder A1 to revolve in the direction shown by the arrow mark, so that hulled grains are received in the recesses . . . , and lifted upward whereas husky grains can not be received in the recesses 1 . . . and slide down on the internal surface of the cylinder. Hulled grains lifted upward leaves the recesses and fall on the spiral conveyor 3A form the receiving through B1, as shown by the arrow mark a6, whereas husky grains conveyed to one end a2 in the upper revolving sorting cylinder A1, as shown by the arrow mark a7, are discharged as they are to be returned to the hopper 16 through the husky grain trough 27 for undergoing rehulling.

On the other hand, hulled grains that have been conveyed to the other end by the spiral conveyor 3A in the receiving trough B1, as shown by the arrow mark a8 fall on the feeding trough A1, conveyed through the lower opening of said feeding trough to the other end a3 of the lower revolving sorting cyclinder A2. Hulled grains mixed with a few quantity of husks are sorted by the lower revolving sorting cyclinder A2 revolving in the direction as shown by the arrow mark a8 in the same way as that by said sorting cylinder A1, so that hulled grains fall from the receiving trough B2 to the spiral conveyor 3B as shown by the arrow mark a10. Hulled grain conveyed by the spiral conveyor 3B, as shown by the arrow mark a11, are conveyed through the trough 33 and flow-down plate 34, pneumatically sorted with air for sorting, fall on the hulled rice conveyor 9, thrown upward by the hulled rice thrower 21 and are discharged outside the device; whereby husky grains mixed with hulled grains and conveyed in the lower revolving sorting cylinder A2, as shown by the arrow mark a12, fall down from one end A4 of the cylinder through the flow-down plate 32 to be thrown upward by the mixed rice thrower 20 to the fed tank 26 for resorting.

In this cae, slant degrees of adjusting plates 4 and 4 can be adjusted by turning adjusting means 5A and 5B along the fluted segments 38 and 38 while adapting pins 37 engage with the flutes of segments, and, as a result, conditions under which hulled rice grains leave the recesses 1 . . . and fall on the troughs B1 and B2 can be controlled, which ensures an adjustment of rice grain sorting.

This invention as disclosed in the foregoing description of objects thereof, can provide a vibration-less rotary type grain sorter quite easy to operate, requiring no particular sorting technique, and without depending on the kind of rice, regardless of whether it is in the husk or hulled, or the dryness thereof because a plurality of revolving sorting cylinders are adapted to perform rough sorting as well as fine sorting, this serving for further improvement of sorting performance, leading to high accuracy in sorting.

In addition, a combination of hulling and pneumatic sorting parts is perfected and, therefore, facilitates smoother conveyance and return of grains to every part.

An adjusting plate provided in the receiving trough in the revolving sorting cylinder and adjustable in the slant degree thereof optimizes sorting accuracy.

Still further, a centralized arrangement of power transmission means for the various parts, efficient power transmission thanks to the well-balanced body of the device, and ease in servicing, leads to this device having a high degree of safety.

What is claimed is:

1. In a rice hulling and sorting machine, the combination including:

two horizontally disposed sorting cylinder means arranged for rotation about their longitudinal axes;

each of said sorting cylinder means also including fixed trough means extending generally horizontally along the length of the interior thereof;

each of said trough means having conveyor means for moving material therein longitudinally thereof;

the interior surface of each of said sorting cylinder means being provided with a multitude of generally radially inwardly facing recesses, each of said recesses being of a size to temporarily receive a single grain of rice when disposed in a lower portion of its circumferential path of movement and to discharge said received grain of rice into said trough means when disposed in an upper portion of its path of movement;

a hulling mechanism having a hopper into which unhulled rice grains are to be initially introduced;

means for feeding rice grains treated by said hulling mechanism to the interior of one end of one of said sorting cylinder means;

means for feeding rice grains from the trough means of said one sorting cylinder means into the interior of one end of the other sorting cylinder means;

means for feeding rice grains remaining in said one sorting cylinder means at the other end thereof directly to the hopper of said hulling mechanism for repeated treatment thereby;

means for feeding rice grains remaining in said other sorting cylinder means at the other end thereof to the interior of said one end of said one sorting cylinder means for repeated treatment therein, and;

means for discharging hulled rice grains from the trough means at the other end of said other sorting cylinder means to the exterior of said hulling and sorting machine.

2. Rice hulling and sorting machine according to claim 1 wherein:

said two sorting cylinder means are mounted for rotation on parallel driving shafts;

said hulling mechanism including a pair of hulling rolls mounted on rotary shafts arranged perpendicularly with respect to said first mentioned shafts;

said hulling mechanism also including lower pneumatic sorting means arranged to receive mixed rice grains, from said hulling rolls.

3. Rice hulling and sorting machine according to claim 1, wherein:

said hulling mechanism including an upper part provided with hulling rolls mounted for rotation about axes perpendicular to the axes of rotation of said sorting cylinder means;

said hulling mechanism also including lower pneumatic sorting means for feeding mixed rice grains to the one end of the upper sorting cylinder means;

the other end of said one sorting cylinder means being disposed to discharge rice grains not received in said recesses directly to said hulling rolls.

4. Rice hulling and sorting machine according to claim 1, wherein:

the other end of both of said sorting cylinder means is disposed to discharge rice grains to said hulling mechanism, and;

drive transmission means for said sorting cylinder means and hulling mechanism is disposed adjacent said one end of said sorting cylinder means.

5. Rice hulling and sorting machine according to claim 1, wherein:

said hulling mechanism includes pneumatic sorting means;

the other end of said other sorting cylinder means being disposed to feed said pneumatic hulling means; and power transmission means are mounted, at one side of the sorting cylinder means for driving the sorting cylinder means and hulling mechanism.

6. Rice hulling and sorting machine according to claim 5, wherein said power transmission means includes a first belt-and-pulley means for driving said hulling mechanism and a second belt-and-pulley means for driving said sorting cylinder means, and a common gear case for driving both of said belt-and-pulley means.

7. In a rice hulling and sorting machine, the combination including:

horizontally disposed sorting cylinder means arranged for rotation about its longitudinal axis;

fixed trough means extending generally horizontally along the length of the interior of said sorting cylinder means;

the interior surface of said sorting cylinder means being provided with a multitude of generally radially inwardly facing recesses, each of said recesses being of a size to temporarily trap therein a single grain of unpolished rice when disposed in a lower portion of its circumferential path of movement and to discharge said trapped grain of rice into said trough means when disposed in an upper portion of said movement;

said trough means including an adjusting plate extending in the longitudinal direction of the trough means and upwardly from one side thereof, the lower margin of said plate being pivotally mounted for adjusting the angle of inclination of the plate.

8. Rice hulling and sorting machine according to claim 7, wherein said trough means includes conveyor means for discharging rice grains at one end thereof.

* * * * *